106-15.05 SR
1/25/83 XR 4,370,366

United States Patent [19]

Deiner

[11] 4,370,366

[45] Jan. 25, 1983

[54] PROCESS FOR THE PRODUCTION OF AN ESTER MIXTURE, EMULSIONS CONTAINING THIS MIXTURE, AND THE APPLICATION THEREOF

[75] Inventor: Hans Deiner, Neusäss, Fed. Rep. of Germany

[73] Assignee: Ciba-Geigy Corporation, Ardsley, N.Y.

[21] Appl. No.: 292,078

[22] Filed: Aug. 12, 1981

[30] Foreign Application Priority Data

Aug. 23, 1980 [DE] Fed. Rep. of Germany ..... 3031933

[51] Int. Cl.[3] ..... B05D 3/02; C07C 67/02; C09F 5/08

[52] U.S. Cl. ..... 427/389.9; 252/106; 252/107; 260/410.5; 424/70; 424/311; 424/312; 560/255; 106/15.05; 106/18

[58] Field of Search ..... 424/311, 312, 70; 260/410.5; 560/255, 256, 254; 427/389.9; 252/106, 107; 106/15.05, 18

[56] References Cited

U.S. PATENT DOCUMENTS

| | | | |
|---|---|---|---|
| 2,082,790 | 6/1937 | Cherry | 260/410.5 |
| 2,907,723 | 10/1959 | Greenlee | 260/410.5 |
| 2,919,200 | 12/1959 | Dubin et al. | 106/15.05 |
| 3,181,292 | 5/1965 | Michalski | 424/311 |
| 3,210,376 | 10/1965 | Smith | 260/410.5 X |
| 3,579,561 | 5/1971 | Meltsner | 260/410.5 X |
| 3,651,101 | 3/1972 | Boldt et al. | 260/410.5 |

FOREIGN PATENT DOCUMENTS

| | | |
|---|---|---|
| 1191270 | 5/1970 | United Kingdom . |
| 1283326 | 7/1972 | United Kingdom . |

OTHER PUBLICATIONS

Houben-Weyl, Methoden Der Organischen Chemie, Band VIII, Sauerstoffverbindungen III, (1952), pp. 519-521.

Lindner Bd II, "Schutz gegen Fäulnis und Bakterienangriff".

Lindner Bd III, "Grundlagen der Anti-Mykotisch Bakteriostatischen Ausrustung von Textilfasern".

"Die Verrottungsfestausrüstung von Textilien", Ing. E. P. Frieser, Wien, 1964 (5).

*Primary Examiner*—Thurman K. Page
*Attorney, Agent, or Firm*—Edward McC. Roberts

[57] ABSTRACT

Mixtures of esters of chlorine-substituted phenols are employed for the protection of textile materials from attack by micro-organisms. Dichlorophene, acetic anhydride and fatty acids with 6 to 20 carbon atoms are reacted together, and the acetic acid formed and excess acetic anhydride are substantially removed by distillation. Concentrated aqueous emulsions of the resulting mixture of esters are then produced for application to textiles.

6 Claims, No Drawings

PROCESS FOR THE PRODUCTION OF AN ESTER MIXTURE, EMULSIONS CONTAINING THIS MIXTURE, AND THE APPLICATION THEREOF

BACKGROUND OF THE INVENTION

The invention relates to the production of an ester mixture comprising 2,2'-dihydroxy-5,5'-dichloro-diphenyl methane, acetic anhydride and higher fatty acids, emulsions which contain this ester mixture, and the use thereof for the protection of cellulose-containing textile material against the attack of micro-organisms.

2,2'-dihydroxy-5,5'-dichloro-diphenyl methane, also known as dichlorophene for short, is a disinfectant widely used because of its bactericidal, fungicidal and deodorant properties, being added to fine soaps, powders, shampoos and the like.

To allow dichlorophene to be used as a preservative agent for protecting textiles it must be in a form suitable for this purpose. Dichlorophene can in fact be converted to an aqueous dispersion, but dispersions which contain high-melting substances in dispersed form have a strong tendency to sedimentation of the dispersed particles. This has the result that, even after re-dispersion, when used on textiles a uniform distribution on the textile material is not guaranteed, more particularly also because the sedimentation takes place particularly quickly in the diluted liquors required for the finishing of textiles. The use of water-soluble alkali salts of dichlorophene is inhibited by the fact that a process for the preservation of textile material is combined frequently with a process for making textile material water repellent or with other processes for improving it otherwise, in a single operation. The substances used for such purposes are, as a rule, not compatible with the water-soluble salts of dichlorophene, i.e. precipitation occurs.

Another method of using dichlorophene for the above-mentioned purpose consists in that the dichlorophene is applied in the form of a solution in a water-insoluble solvent to the textile material. But frequently textile firms are not equipped for the finishing of textile material with products in the form of solutions in organic solvents, since special apparatus are required for application of the solvents and for their recovery, which is necessary in order to avoid ecological problems, and such apparatus involve high investment costs.

SUMMARY OF THE INVENTION

An object of the invention is to provide a mixture of esters of dichlorophene produced in a simple way that can easily be converted to stable emulsions which are very suitable for protecting textile materials against the attack of micro-organisms, without the aforesaid disadvantages occurring.

A further object of the invention is to provide such stable emulsions in which microbicidal activity is substantially not prejudiced by the esterification, since owing to the gradual re-hydrolysis of the esters the actively effective dichlorophene is always re-formed in adequate quantities.

The process according to the invention for the production of a mixture of esters of chlorine-substituted phenols is characterised in that (a) 1 mol of 2,2'-dihydroxy-5,5'-dichloro-diphenyl methane with (b) 1.0 to 2.5 mols of acetic anhydride and (c) 0.8 to 2.2 mols of fatty acids with 6 to 20 C atoms are reacted under reflux, and the acetic acid formed and also any excess acetic anhydride are largely removed by distillation under elevated temperature. It is convenient in the final phase to distil-off the still voltatile constituents by distillation at reduced pressure.

The invention also concerns emulsions which contain in emulsified form the ester mixture produced in accordance with the process proposed by the present invention, and the use of these emulsions for the production of textile material against the attack of micro-organisms.

Hitherto only the reaction of the respective fatty acid chloride with the alkali salts of the chlorinated phenol has been found satisfactory for the preparation of esters of higher fatty acids of chlorinated phenols. Thus, with this method, for example the dilauric acid ester of 4,4'-dihydroxy octachloro diphenyl is accessible, as British Pat. No. 1,283,326 shows. But the production of acid chlorides is complicated, since in these cases e.g. when reacting the fatty acid with thionyl chloride, acid gases are produced which have to be absorbed and rendered innocuous, or when reacting with phosphorus oxychloride the phosphoric acid produced has to be removed carefully. In addition, usually distillation of the fatty acid chlorides under reduced pressure is unavoidable.

Although the acetic acid esters of chlorinated phenols can readily be produced by reaction with acetic anhydride—the acetic acid forming being removed in a simple manner by distillation—these have the disadvantage that, emulsified in dissolved or melted form, they are prone to recrystallisation, so that the emulsions become unusable again. This is true even if the acetic acid ester is transesterified by acidolysis with a higher fatty acid. Since the transesterification is not carried out completely, products having this basis tend after emulsification to crystallise even if they contain only relatively small quantities of acetic acid esters.

Remarkably, these disadvantages do not occur in the case of reacting 2,2'-dihydroxy-5,5'-dichloro-diphenyl methane with acetic anhydride and higher fatty acids, although the mixtures obtained contain significant quantities of acetic acid in esterified form.

DESCRIPTION OF THE PREFERRED EMBODIMENTS

The invention will be more fully understood from the following detailed description.

The procedure when producing ester mixtures as proposed by the invention is that 1 mol of dichlorophene is heated together with 1 to 2.5 mols of acetic anhydride and 0.8 to 2.2 mols of higher fatty acid, with reflux, for a period of 1 to 4 hours, then the acetic acid formed and any excess acetic anhydride are distilled off under normal pressure at elevated temperature. Advantageously the residual volatile constituents are removed under reduced pressure i.e. at about 60 to 15 mbar, likewise at elevated temperature. Both when carrying out distillation at normal pressure and when distilling under reduced pressure it is readily possible to use temperatures up to 200° C. and above.

It is advantageous but not absolutely necessary to carry out the removal by distillation of the acetic acid by means of a distillation column. This method has the advantage that the heating with reflux can be shortened.

As will be apparent, theoretically the bis fatty acid esters of dichlorophene can also be obtained with this process. However, preferably dichlorophene is reacted with the fatty acid in a molar ratio of 1:0.8 to 1.2, more particularly 1:1, although of course in this case the proportion of acetic acid contained in the mixture in esterified form is higher than in the event of a reaction ratio of 1:2 mols. The main reason for the choice of the molar ratio of 1:1 is that with this ratio the active constituent of the mixture, namely the dichlorophene (in esterified form) is then present in the mixture in relatively large quantity. Despite the relatively high proportion of acetic acid present in esterified form, the emulsions produced with such mixtures are likewise stable.

The relationship of dichlorophene to acetic anhydride amounts to 1:1 to 2.5 mol. But it is advantageous to use 2 to 2.5 mols of acetic anhydride per mol of dichlorophene, since in fact direct reaction of the acetic acid with the dichlorophene scarcely occurs even with high temperature, and on the other hand the acetic acid forming in the event of esterification with acetic anhydride can be distilled off.

In a mixture produced in this way (reaction ratio of dichlorophene to acetic anhydride to higher fatty acid 1:2.4:1) monoacetic acid ester, fatty acid/acetic acid mixed ester, bis fatty acid ester and also, in small quantities, the mono fatty acid ester of 2,2'-dihydroxy-5,5'-dichloro-diphenyl methane could be identified. The main fraction of the mixture consists of the mixed and the bis fatty acid esters of the dichlorophene.

The fatty acids used for esterification have 6 to 20 C atoms. Both saturated and unsaturated fatty acids may be used. In addition, the alkyl may also be branched. As examples there may be mentioned caproic, capric, lauric, palmitic and stearic acids, also oleic and undecylenic acid. 2-ethyl caproic acid may be mentioned as an example of a branched-chain acid. However, commercial mixtures of higher fatty acids whose acid numbers are from 195–270 are preferably used for esterification. They contain as main constituents lauric and myristic acids, but may also contain relatively large amounts of singly and multiply unsaturated higher fatty acids. Their acid number is in a range from 195 to 270. These commercial fatty acids have not only the advantage that they are consideralby cheaper than the pure fatty acids, but also the advantage that there is even less risk of recrystallisation in the emulsion, since a plurality of different esters are present side by side.

The mixtures of esters can be converted to emulsions in a manner known per se. The emulsifiers used are those conventionally used for production of emulsions usable in the textile industry. Since the microbicidal finishing of textile materials is usually combined with other improving processes normal in the textile industry, such as making the material water repellent or flame resistant and the like, care needs to be taken to use, for emulsifying the mixture of fatty acid esters, emulsifiers which are compatible with the substances normally used for these purposes, in other words usually cation active and non-ionogenic emulsifiers. There is no need to list individual emulsifiers, since they will be familiar to the person skilled in the art.

Emulsification is carried out in the usual way in apparatus known for the purpose. Generally the ester mixture as such is allowed to run in melted-down state at about 40°–70° C., or in the form of a solution in water-insoluble solvent, with vigorous stirring, into an aqueous solution containing the emulsifier, and then the pre-emulsion obtained is homogenised on a suitable apparatus. It is of course possible also to use in the emulsification other adjuvants such as protective colloids as well as the emulsifiers, or to include in the emulsion also other substances which favourably influence the microbicidal properties or widen the range of effectiveness of the dichlorophene.

In this way stable emulsions can be produced which contain 30 to 50% by weight of ester mixture.

The emulsions thus obtained are applied to the textile material in a form diluted with water by spraying, padding or the like, so that the ester mixture amounts to about 1 to 5% of the solids deposit.

Textile materials concerned include substantially all which are vulnerable to attack by micro-organisms. More particularly articles may be mentioned in this connection which are open to a danger of being rotted by mildew or mould fungus such as camping fabrics and heavy fabrics for awnings or sail cloths, or blinds or shower curtains. If the microbicidal finishing is of special significance for textile material which contains cellulose fibres, it is still significant also for purely synthetic textile material e.g. having a base of polyester, polyacrylnitrile or polyvinyl alcohol fibres. For these materials often contain finishes which provide nourishment for micro-organisms, so that growths may result unless microbicidal treatment has been carried out.

The test for resistance to mould funguses is carried out in accordance with DIN 53 931. According to that Standard the funguses (see section "use on textile material") are cultivated at 29±1° C. on oat-, malt- or mineral salt-cellulose-agar in slant tubes. The fungus cultures obtained are conveniently stored at 5° to 10° C. To obtain sport suspensions, agar slant tubes are inoculated with these cultures and, after good sporing, each washed twice with 5 ml of sterile water. The nutrient medium plates produced in known manner are uniformly inoculated with 0.5 ml spore suspension and then stored 24 hours at 29±1° C. Then the samples and the comparison samples are put on, subjected to slight pressure, and tested 2 weeks with a relative air humidity of 60 to 80%. Results are finally evaluated in accordance with the following scale:

00 entire plate free of growth
0 halo formation (growth-free zone encircling the sample)
(0) fungus has grown up to the sample
1 same overgrown only at the edge
2 sample overgrown from the edge (less than 25%)
3 sample surface overgrown with individual colonies (25 to 75%)
4 sample surface covered with widespread growths (75% and more, but not the whole surface)
5 sample surface completely overgrown (100%)

The test described is carried out both directly after finishing and also after 24-hour watering in accordance with DIN 53 930 (at 20±2° C. in running water with a liquor ratio of at least 1:100 and changing water five times per hour).

A rotting test as specified in DIN 53 930 is also carried out. For this, the samples are buried vertically in the test earth (mixture of equal parts of coarse sand, comminuted peat, well rotted herbivore dung and matured compost earth), only a length of 10 to 20 mm projecting out of the earth, and the spacing of the samples is to amount to not less than 50 mm. After 2 weeks the samples are taken out, washed briefly under running water, and dried in air with a normal atmosphere.

Evaluation is carried out by determining the tearing strength loss as compared with comparison samples stored in a normal atmosphere.

PRODUCTION OF ESTER MIXTURES

Example 1

424 g of a fatty acid mixture with an acid number of 264 (mixture of 2% capric acid, 52% lauric acid, 22% myristic acid, 10% palmitic acid, 3% stearic acid and 10% oleic acid) are heated for 1 hour with reflux with 480 g of acetic anhydride and 538 g of 2,2'-dihydroxy-5,5'-dichloro-diphenyl methane, and then, with a gradual increase in temperature to 200° C. for 2 hours approximately the acetic acid formed and also some of the excess acetic anhydride are removed by distillation. After a short cooling, a vacuum is applied and the remaining volatile constituents removed by distillation. During this, after a pressure of approx. 20 mbar is reached the temperature is again raised to 200° C. and held for 2 hours at that level.

990 g of a viscous, brown-coloured product with a viscosity of 980 mPa.s. are obtained.

Example 2

564 g of a fatty acid mixture with an acid number of 198 (approx. 1% myristic acid, 10% palmitic acid, 4% stearic acid, 29% oleic acid, 48% linoleic acid, 7% linolenic acid and 1% arachic acid) are boiled with 204 g of acetic anhydride and 269 g dichlorophene for ½ hour with reflux, then during 3 hours the acetic acid forming is removed by distillation by way of a short column. The temperature is raised therein to approx. 200° C. Finally, after cooling and renewed temperature increase to approx. 180° C. the remaining volatile constituents are removed by distillation under a vacuum at 15 mbar during 2 hours.

Approx. 800 g of a brownish-coloured liquid product are obtained.

Example 3

340 g of the fatty acid mixture (composition as in example 1) are reacted in the way described in example 1 with 450 g acetic anhydride and 538 g of 2,2'-dihydroxy-5,5'-dichloro-diphenyl methane.

A product which emulsifies readily is obtained.

PRODUCTION OF THE EMULSIONS

Example 4

400 g of the ester mixture produced according to Example 1, which had been heated together with 50 g of perchloroethylene to 50° C., is made to run into a likewise heated solution of 24 g of polyvinyl alcohol (saponification number 140; viscosity of a 4% solution 25 mPa.s) in 526 g of water with vigorous stirring. Then this pre-emulsion is homogenised.

The emulsion contains 40% by weight ester mixture and is stable in storage.

Example 5

450 g of the ester mixture produced according to Example 3 are, after heating to 70° C., stirred into a solution of 24 g of polyvinyl alcohol (data see Example 4) in 526 g of water at a temperature of 70° C. Further processing is carried out as indicated in Example 4.

Example 6

340 g of a solution of a condensation product of epoxy resin and diethylene triamine, the production of which is described in Example 7 of British Pat. No. 1,071,162, are diluted with water to 600 g. After heating to 60° C. there are allowed to run thereinto, with vigorous agitation, 400 g of the ester mixture produced in accordance with Example 1, also heated to 50° C. After homogenisation a stable emulsion is obtained which contains 40% by weight of ester mixture in emulsified form.

USE ON TEXTILE MATERIAL

Example 7

A cotton sail cloth with a weight of 420 g per $m^2$ is treated on a pad with a liquor containing 60 g/l of the emulsion according to Example 4, and squeezed out to a liquor takeup of 50% by weight. Then drying is carried out at a temperature of 110° to 130° C.

Example 8

The same cotton sail cloth as in Example 7 is treated with a liquor which contains per liter 60 g of the emulsion according to Example 4 and 150 g of a commercially obtainable zirconium-fatty acid-paraffin emulsion with a solids content of 30% by weight. It is squeezed out to a liquor takeup of 55% by weight and dried at approx. 120° to 130° C.

The test for resistance to mould funguses in accordance with DIN 53931 before and after washing (DIN 53930) for the samples treated according to Examples 7 and 8 gives for all 3 tested mould funguses, namely Aspergillus niger, Chaetomium globosum and Penicillium funiculosum, the evaluation "(0)" i.e. the fungus had grown up to the sample, but the sample itself was free of growths.

In the rotting test a tearing strength loss of 5.2% is obtained for the sample according to Example 7, and when carrying out the rotting test after washing a tearing strength loss of 15%. The corresponding values when testing the sample according to Example 8 are 3.3% and 12.8% respectively.

What is claimed is:

1. Process for the production of a mixture of esters of chlorine substituted phenols, characterised in that (a) a mol of 2,2'-dihydroxy-5,5'-dichloro-diphenyl methane with (b) 1 to 2.5 mols of acetic anhydride and (c) 0.8 to 2.2 mols of fatty acids with 6 to 20 C. atoms are reacted together, with reflux, and the acetic acid formed and also any excess acetic anhydride are largely removed by distillation at elevated temperature.

2. Process according to claim 1, characterised in that the distillation is carried out in the final phase under reduced pressure.

3. Process according to claims 1 and 2, characterised in that the components (a), (b) and (c) are reacted in the molar ratio 1:2 to 2.5:0.8 to 1.2.

4. Process according to claims 1 and 2, characterised in that commercial fatty acid mixtures with an acid number range of from 195 to 270 are used as component (c).

5. A concentrated aqueous emulsion containing the mixture of esters produced in accordance with claim 1 in emulsified form.

6. Process for the protection of a textile material against the attack of micro-organisms, comprising the steps of:

(i) producing a mixture of esters of chlorine-substituted phenols in accordance with claim 1, (ii) forming a concentrated aqueous emulsion containing said mixture of esters in emulsified form, (iii) applying said aqueous emulsion to said textile material followed by drying at a temperature of 110°–130° C.

* * * * *